US006872123B2

(12) United States Patent
Sudo et al.

(10) Patent No.: US 6,872,123 B2
(45) Date of Patent: Mar. 29, 2005

(54) METHOD OF AND APPARATUS FOR LAPPING MAGNETIC HEAD SLIDER

(75) Inventors: Koji Sudo, Kawasaki (JP); Mitsuo Takeuchi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/747,290

(22) Filed: Dec. 30, 2003

(65) Prior Publication Data

US 2004/0162005 A1 Aug. 19, 2004

(30) Foreign Application Priority Data

Feb. 18, 2003 (JP) ..... 2003-039596

(51) Int. Cl.[7] ..... B24B 49/00
(52) U.S. Cl. ..... 451/10; 451/57; 451/272
(58) Field of Search ..... 451/10, 41, 57, 451/286, 287, 270, 272; 29/603.12, 603.15, 603.16

(56) References Cited

U.S. PATENT DOCUMENTS 5,749,769 A * 5/1998 Church et al. ..... 451/5
5,816,899 A * 10/1998 Hart et al. ..... 451/272
6,238,276 B1 * 5/2001 Miyazaki et al. ..... 451/266
6,497,611 B2 * 12/2002 Sakurada et al. ..... 451/5
6,758,725 B1 * 7/2004 Sudo et al. ..... 451/41
2002/0031979 A1 3/2002 Sakurada et al.

FOREIGN PATENT DOCUMENTS

JP 7-14138 1/1995
JP 2001-162526 6/2001

* cited by examiner

*Primary Examiner*—Dung Van Nguyen
(74) *Attorney, Agent, or Firm*—Armstrong, Kratz, Quintos, Hanson & Brooks, LLP

(57) ABSTRACT

The apparatus for lapping a magnetic head slider includes a lapping plate to which a bar of the magnetic head slider makes a contact by a predetermined lapping pressure, a primary oscillating mechanism that makes a primary oscillating of the bar in a radial direction of the lapping plate, and a secondary oscillating mechanism that makes a secondary oscillating of the bar in a direction perpendicular to a direction of the primary oscillating. A coarse lapping of the bar is performed by a combined oscillating of the primary oscillating and the secondary oscillating, and upon completion of the coarse lapping, the apparatus switches to the primary oscillating to finish lapping of the bar.

10 Claims, 21 Drawing Sheets

METHOD OF AND APPARATUS FOR LAPPING MAGNETIC HEAD SLIDER

BACKGROUND OF THE INVENTION

1) Field of the Invention

The present invention relates to a method of and an apparatus for lapping a magnetic head slider, and more particularly, to a method of and an apparatus for lapping a magnetic head slider that further enhances lapping precision and prevents formation of a scratch or a smear in gaps of magnetoresistive (MR) elements or electrical lapping guide (ELG) elements.

2) Description of the Related Art

Recently, with increase in capacity of a hard disk drive, it is required to reduce a size and a width of a track and a gap of a combined type magnetic head having a slider. Since a thin magnetic film becomes more popular, precise control with excellent productivity is required also in lapping process of the magnetic head slider.

Generally, in a conventional working process of the magnetic head slider, since a row bar in which a plurality of magnetic head elements are aligned in a line is cut out from a wafer and the cut out row bar is lapped into a desired size, the row bar is pushed against a lapping plate under a predetermined pressure and the row bar is lapped.

FIG. 20 is a schematic diagram of a row bar as viewed from a surface of the row bar to be lapped. That is, on the row bar 10, magnetic head sliders 11 and work-monitoring resistive elements, electrical lapping guide (ELG) elements 12, are alternately arranged. Each of the magnetic head sliders 11 comprises an alumina section 13 and an alumina carbonized-titanium section 14. The alumina section 13 includes an upper magnetic pole 15, an upper shield (lower magnetic pole) 16, an MR film 17 and lower shield 18.

As means for precisely lapping such a row bar 10, the present inventor, for example, proposed a lapping method and a lapping apparatus disclosed in Japanese Patent Application Laid-Open No. 2001-162526. A lapping direction component of the row bar 10 by this lapping apparatus will be explained with reference to FIG. 21. FIG. 21 is a schematic diagram of the lapping direction component as viewed from the surface of the row bar to be lapped. FIG. 21 depicts the surface 10*a* of the row bar 10 to be polished and a turning and oscillating center 19 of the row bar 10. A lapping direction component and a surface plate rotation direction are shown with arrows in FIG. 21.

The lapping apparatus includes a rotating lapping plate, first oscillating mechanism which simply primary oscillates the mounted row bar 10 such that the row bar 10 reciprocates in the radial direction of the lapping plate, and a second oscillating mechanism which turns and secondary oscillates the mounted row bar around itself. A oscillating period of the row bar by the first oscillating mechanism and a oscillating period of the row bar by the second oscillating mechanism are set differently so that the row bar is oscillated in a combined manner.

According to a lapping method by means of this lapping apparatus, the row bar is subjected to a rough lapping first by the simple oscillating and then by the combined oscillating. A resistance ELG-R of the work-monitoring resistor is monitored, and the ELG-R is converted into an MR element height MRh. If the converted value MRh reaches a predetermined value, a supply of coarse slurry is stopped, finishing slurry is supplied, and the row bar is subjected to a finishing lapping by means of the combined oscillating. During the lapping operation, the working pressure and the rotation speed of the lapping plate are reduced in accordance with the proceeding state of the lapping based on the converted value MRh.

In the lapping operation by means of the combined oscillating, the row bar 10 is always moving, there is no moment at which a relative speed between the lapping plate and the surface 10*a* of the row bar 10 to be polished becomes zero. Therefore, a lapped surface is not scratched by the lapping plate. Further, since the lapping direction is not uniform, the row bar can be lapped uniformly and precisely.

Recently, however, gaps, for example, between the MR film 17 and the lower shield 18 of the MR elements of the magnetic head slider 11 or the ELG elements 12 are extremely small, and if the finishing lapping using the combined oscillating is carried out, there is a problem that scratches or smears are formed in the gaps, and the sensitivity of the element may be deteriorated due to a short circuit or the like.

SUMMARY OF THE INVENTION

It is an object of the present invention to solve at least the problems in the conventional technology.

The apparatus for lapping a magnetic head slider according to one aspect of the present invention includes a lapping plate to which a bar of the magnetic head slider makes a contact by a predetermined lapping pressure, a primary oscillating mechanism that makes a primary oscillating of the bar in a radial direction of the lapping plate, and a secondary oscillating mechanism that makes a secondary oscillating of the bar in a direction perpendicular to a direction of the primary oscillating. A coarse lapping of the bar is performed by a combined oscillating of the primary oscillating and the secondary oscillating, and upon completion of the coarse lapping, the apparatus switches to the primary oscillating to finish lapping of the bar. The method of lapping a magnetic head slider according to another aspect of the present invention includes oscillating a bar of the magnetic head slider while the bar is making a contact with a lapping plate by a predetermined lapping pressure. The oscillating includes primary oscillating the bar in a radial direction of the lapping plate, and secondary oscillating the bar in a direction perpendicular to a direction of the primary oscillating. Upon completion of a coarse lapping by the oscillating, performing the primary oscillating to finish lapping of the bar.

The other objects, features and advantages of the present invention are specifically set forth in or will become apparent from the following detailed descriptions of the invention when read in conjunction with the accompanying drawings.

DETAILED DESCRIPTION

Exemplary embodiments of a method of and an apparatus for lapping magnetic head slider according to the present invention will be explained in detail with reference to the accompanying drawings. The invention is not limited by the embodiments.

Figure 1:
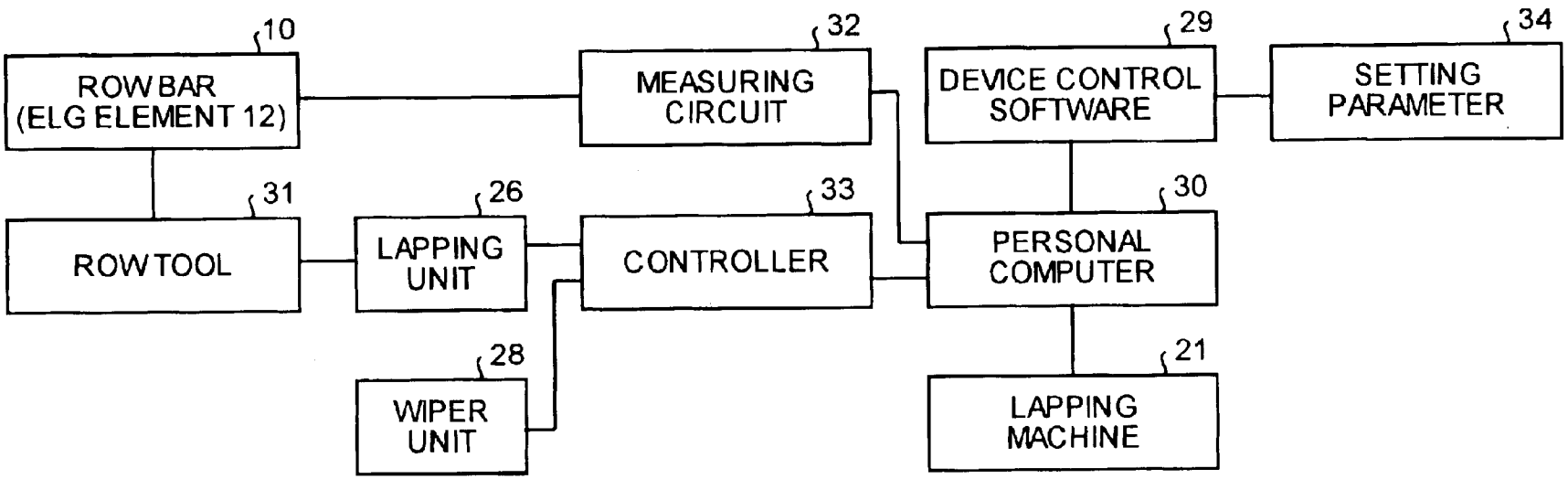
FIG. 1 is a block diagram of a lapping apparatus according to a first embodiment of the present invention.
Figure 2:
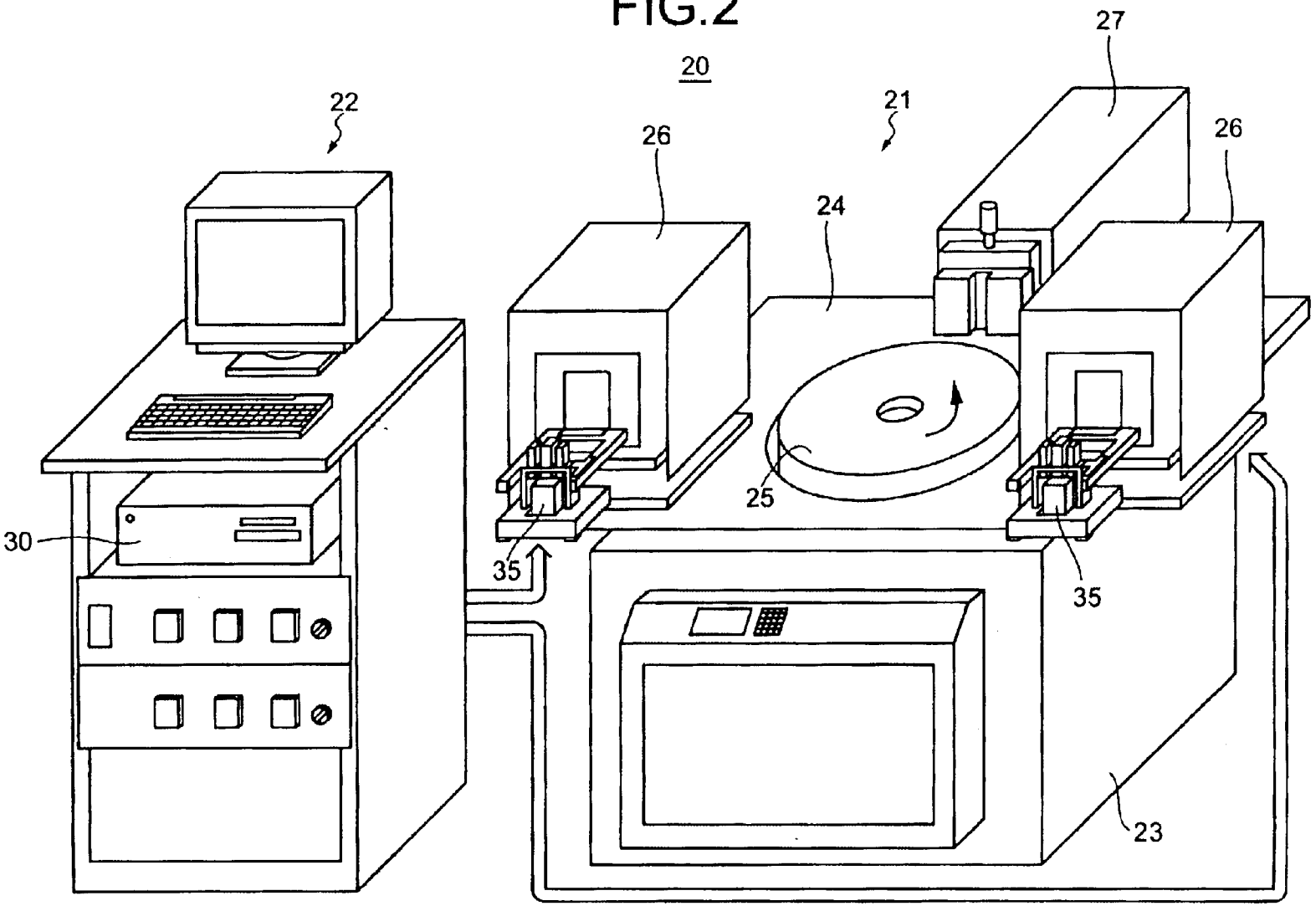
FIG. 2 is a schematic diagram of the lapping apparatus.
Figure 3:
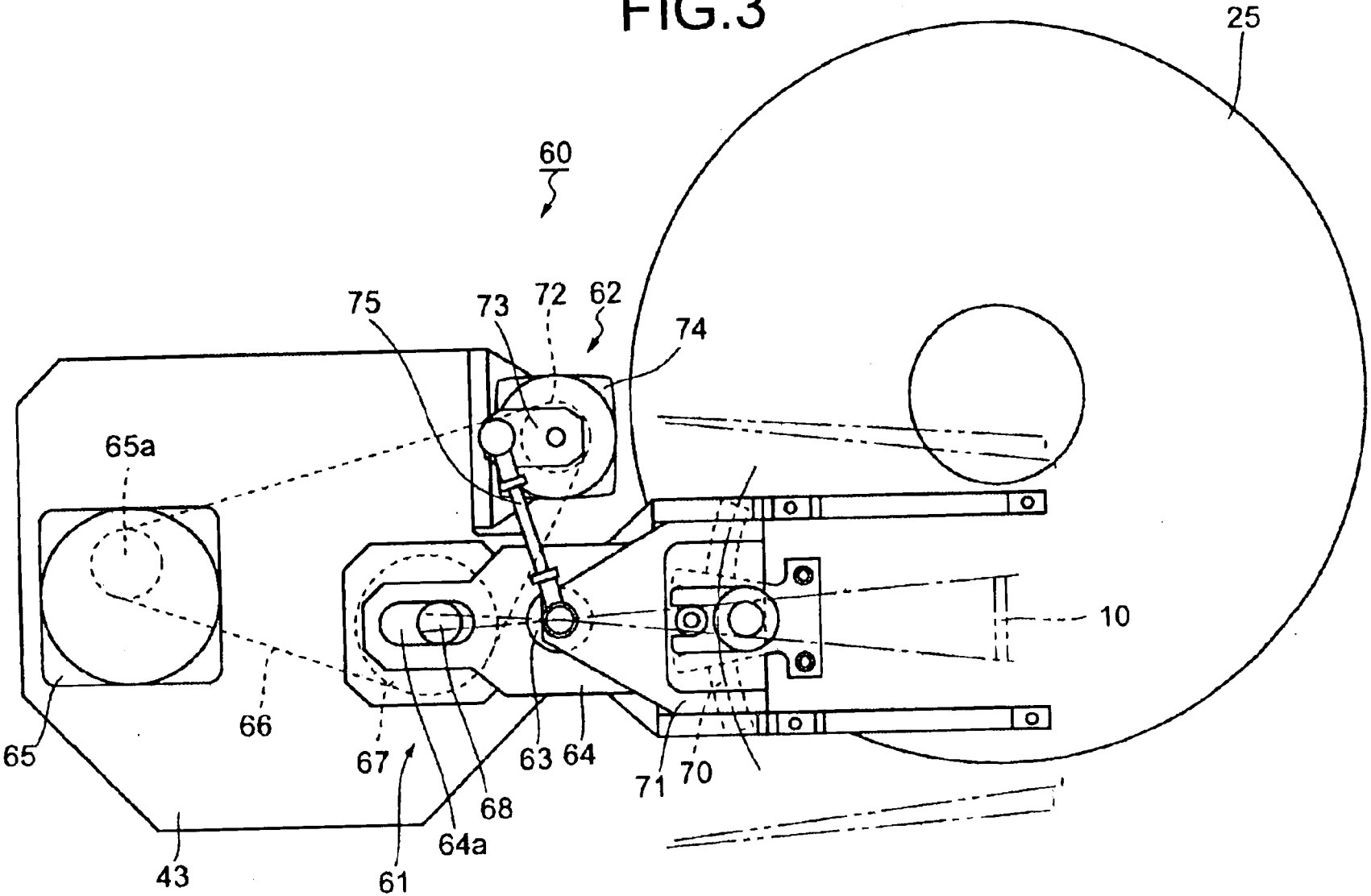
FIG. 3 is a plan view of a combined oscillating mechanism.
Figure 4:
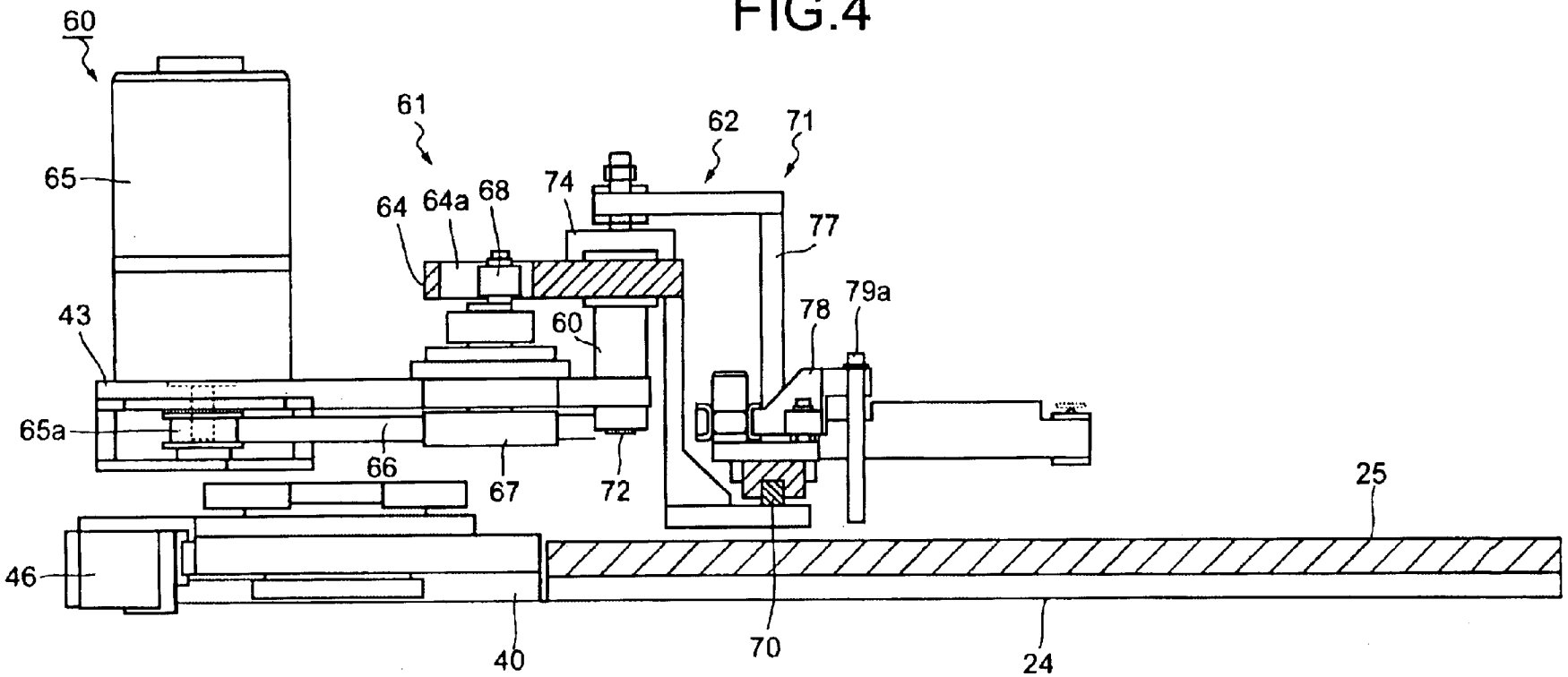
FIG. 4 is a front view of the combined oscillating mechanism.
Figure 5:
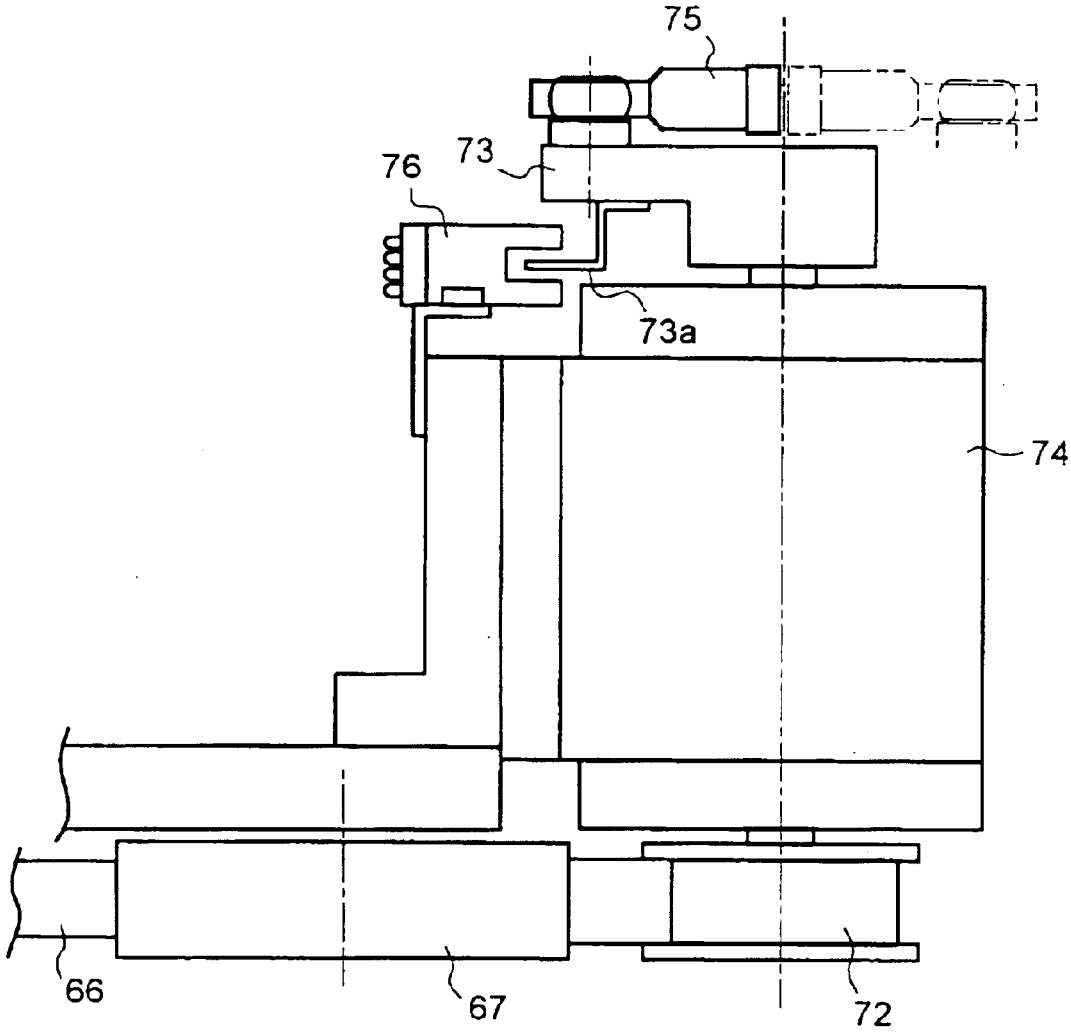
FIG. 5 is a front view of a secondary oscillating mechanism.

FIG. 1 is a block diagram a lapping apparatus according to a first embodiment of the present invention. FIG. 2 is a schematic diagram of the lapping apparatus. FIG. 3 is a plan view of a combined oscillating mechanism. FIG. 4 is a front view of the combined oscillating mechanism. FIG. 5 is a front view of a secondary oscillating mechanism.

Figure 6:
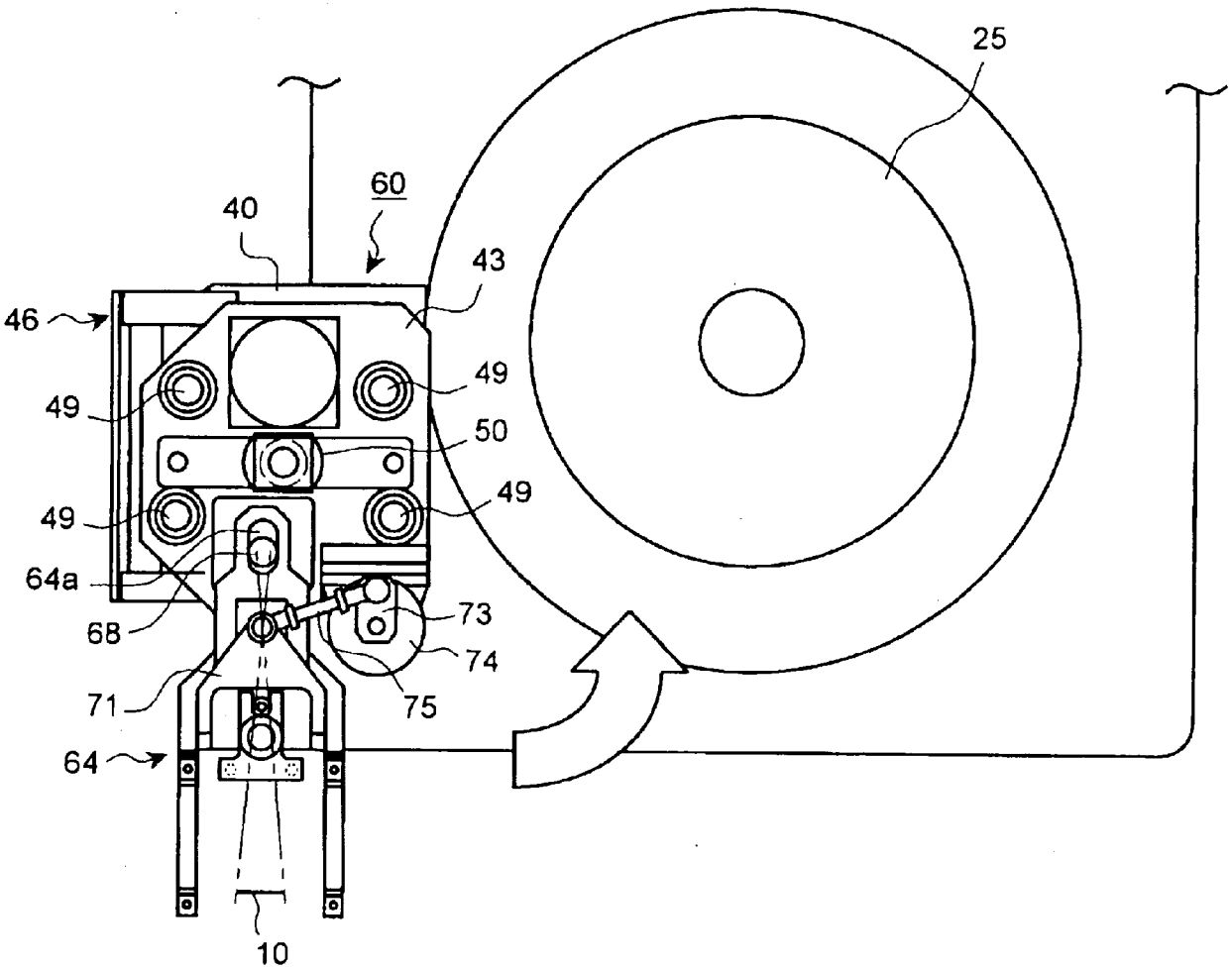
FIG. 6 is a plan view for illustrating a loading motion (before turning of the combined oscillating mechanism)
Figure 7:
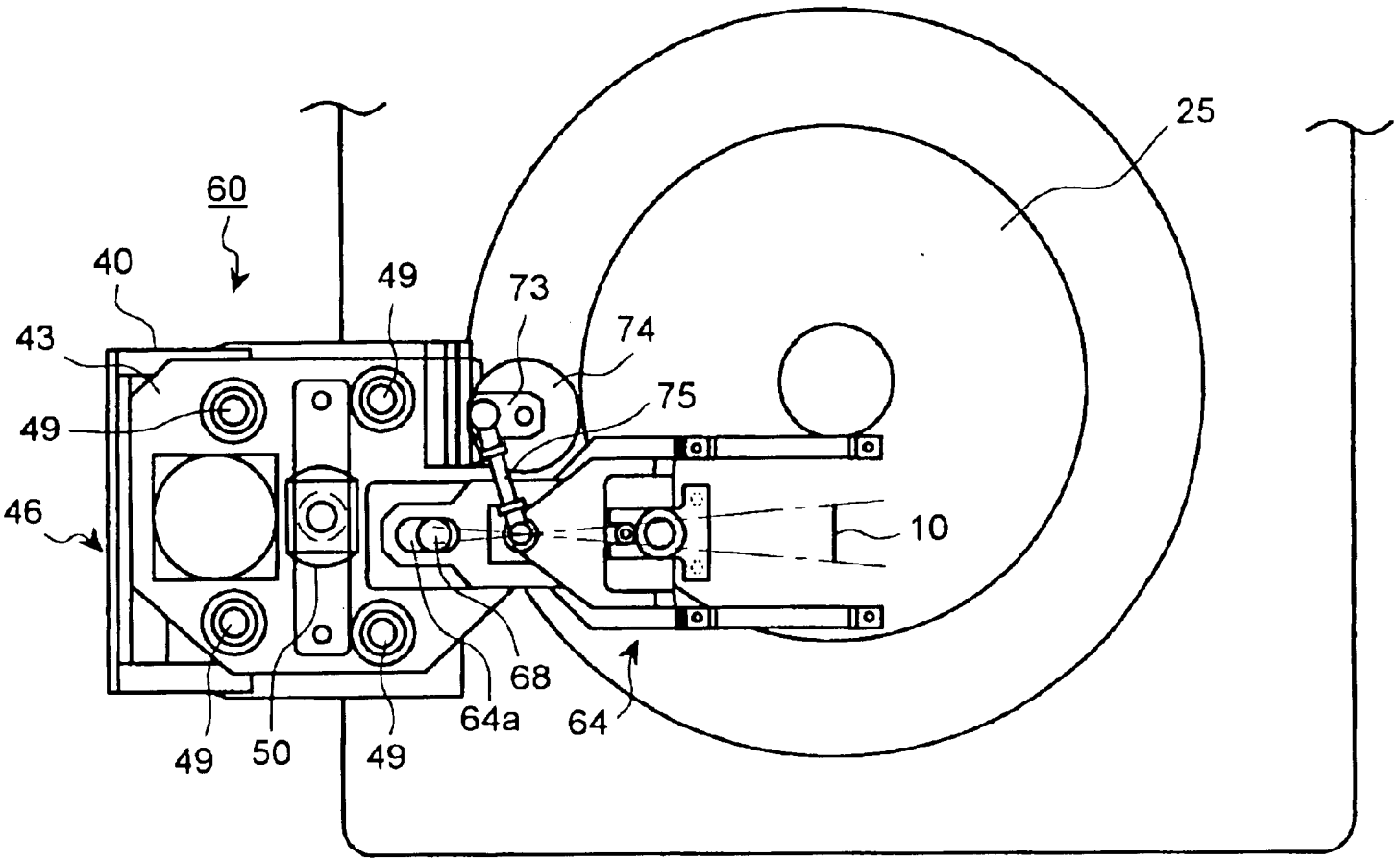
FIG. 7 is a plan view for illustrating the loading motion (after turning of the combined oscillating mechanism)
Figure 8:
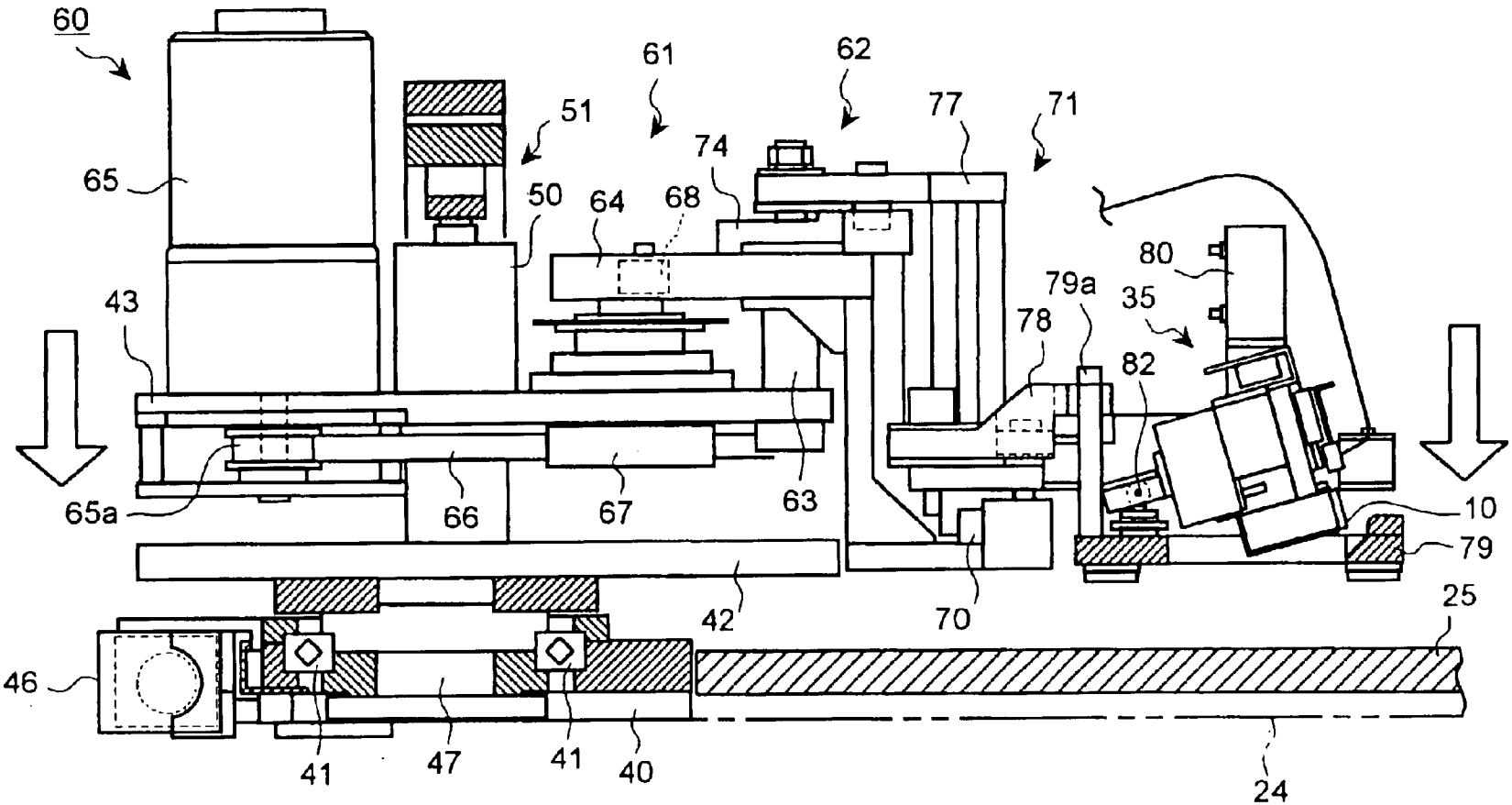
FIG. 8 is a front view for illustrating the loading motion (before an elevating sub-base moves downward)
Figure 9:
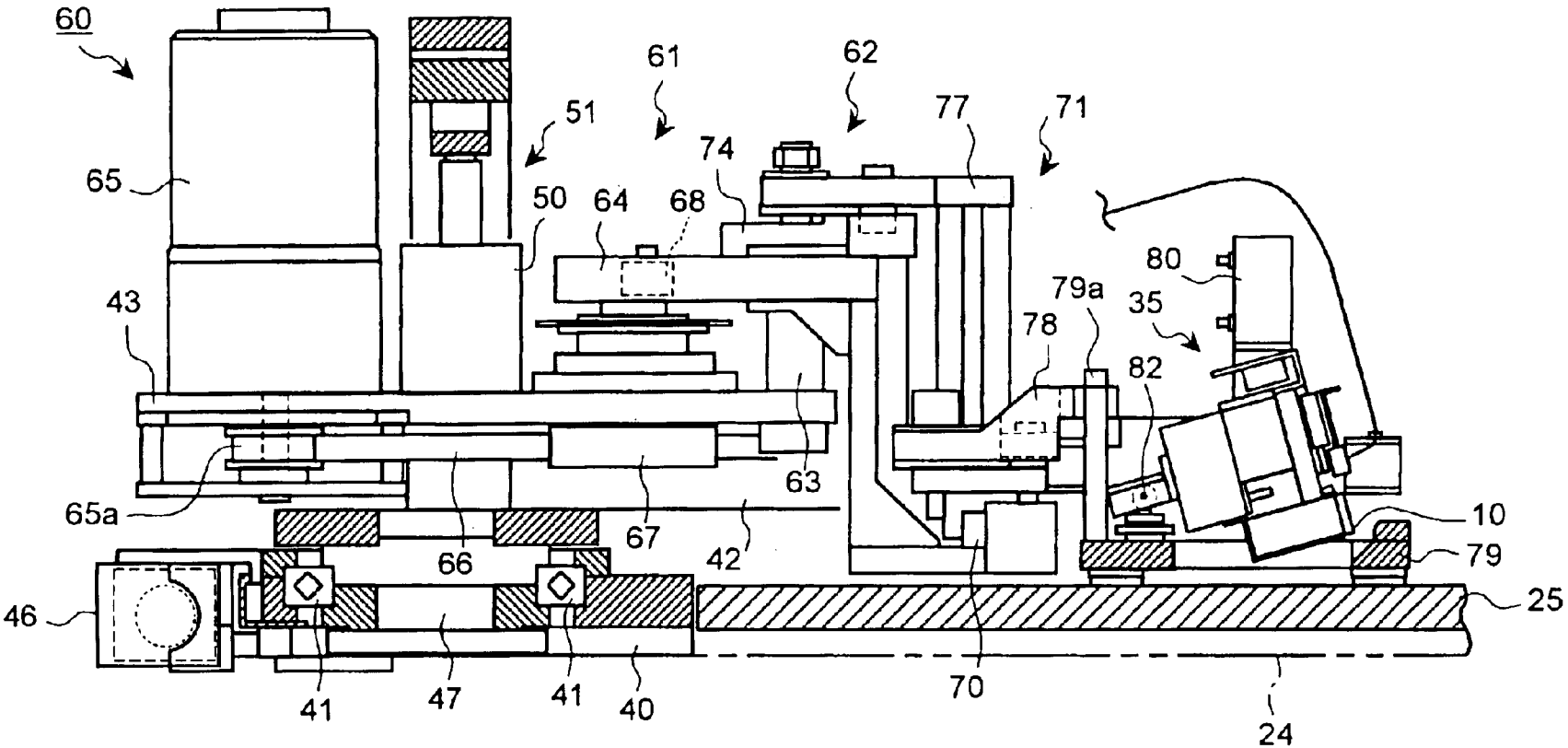
FIG. 9 is a front view for illustrating the loading motion (after the elevating sub-base moves downward)
Figure 10A:
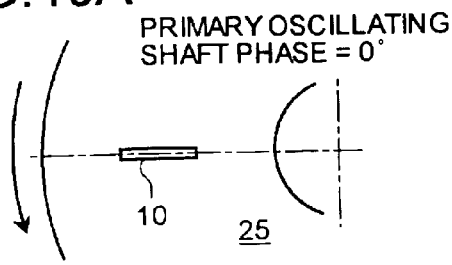
FIGS. 10A to 10H are schematic diagrams for illustrating a process of a combined oscillating motion.
Figure 10B:
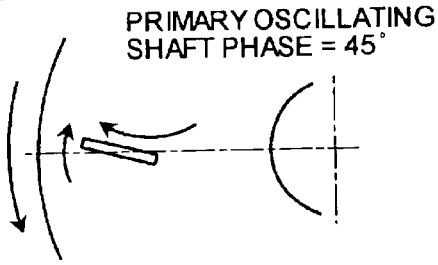
Figure 10C:
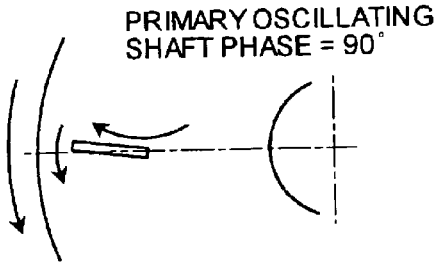
Figure 10D:
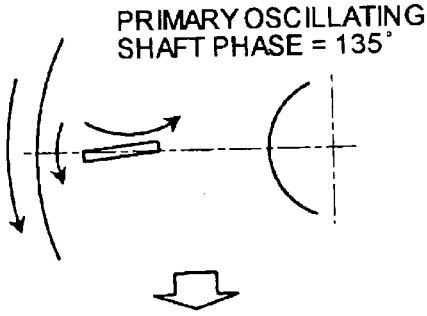
Figure 10E:
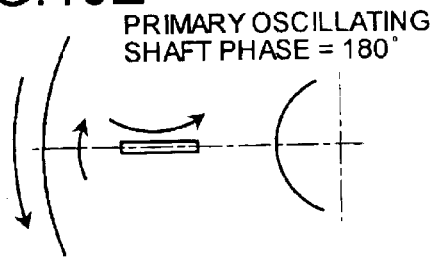
Figure 10F:
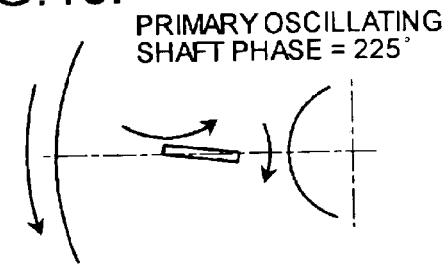
Figure 10G:
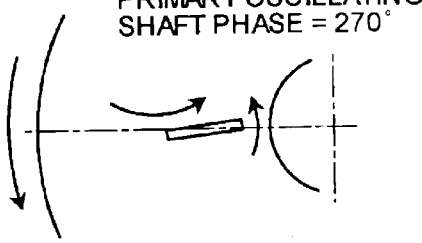
Figure 10H:
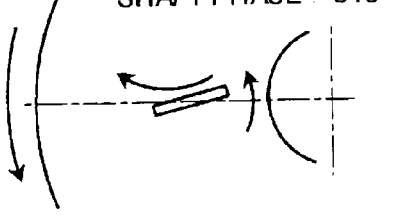

FIG. 6 is a plan view for illustrating a loading motion (before turning of the combined oscillating mechanism). FIG. 7 is a plan view for illustrating the loading motion (after turning of the combined oscillating mechanism). FIG. 8 is a front view for illustrating the loading motion (before an elevating sub-base moves downward). FIG. 9 is a front view for illustrating the loading motion (after the elevating sub-base moves downward). FIGS. 10A to 10H are schematic diagrams for illustrating a process of the combined oscillating. In the following explanation, the same members as those explained above and members corresponding thereto are designated with the same reference symbols, and redundant explanation will be omitted or simplified.

The entire configuration of a lapping apparatus 20 will be explained based on FIGS. 1 to 9. The configuration of the lapping apparatus 20 according to the first embodiment is substantially the same as that shown in the Japanese Patent Application Laid-Open No. 2001-162526, therefore the configuration will be explained briefly. The lapping apparatus 20 comprises a lapping machine 21 and a control device 22.

As illustrated in FIGS. 1 and 2, the lapping machine 21 comprises a table 24 of a table structure 23, a lapping plate 25 which rotates in the counterclockwise direction on an upper surface of the table 24, a pair of left and right lap units 26 and 26 which hold the a row bar 10 through a row tool 31 to push the row bars 10 against the lapping plate 25 by the bend unit 35, a slurry supply unit (not shown) which supplies a slurry to the lapping plate 25, a facing unit 27 that dresses the lapping plate 25, and a wiper unit 28 which scrapes the slurry off the lapping plate 25.

The lapping plate 25 is provided at its upper surface with a correcting ring (not shown) which rotates in a constant direction to spread the slurry on the lapping plate 25. A compressed air source (not shown) which is an actuation source of pressurizing cylinders 50 and 80 of a later-described lap unit 26 is also provided.

As illustrated in FIG. 1, the control device 22 comprises a personal computer 30 which is operated by device control software 29. The control device 22 controls a measuring circuit 32 of a work-monitoring resistance element 12 and a controller 33 which drives the lap unit 26 and the wiper unit 28. Various setting parameters 34 required for controlling the lapping operation such as a converted value MRh in which a resistance ELG-R of the work-monitoring resistance element 12 is converted into an MR element height MRh, and a target value of the converted value MRh are input into the device control software 29.

The lap unit 26 will be explained mainly based on FIGS. 6 to 9. As illustrated in FIGS. 8 and 9, the lap unit 26 comprises a base 40 fixed on the table 24, a turning support plate 42 which is turnably supported on the base 40 by a bearing 41, and an elevating sub-base 43 which moves up and down on the turning support plate 42. The turning support plate 42 turns around a shaft 47 through 90° by a turning mechanism 46 that comprises an air cylinder, a rack and a pinion. The elevating sub-base 43 turns integrally with the turning support plate 42, and moves up and down with respect to the turning support plate 42 by an elevation mechanism 51 while being guided by four guides 49. The elevation mechanism 51 includes a pressurizing cylinder 50.

A combined oscillating mechanism 60 of the lap unit 26 will be explained. The combined oscillating mechanism 60 is provided on the elevating sub-base 43, and oscillates the row bar 10 in a combined manner with respect to the lapping plate 25. That is, the combined oscillating is obtained by combining primary oscillating (simple oscillating) which reciprocates the row bar 10 as a work in the radial direction of the rotating lapping plate 25, and a secondary oscillating (swivel oscillating) which reciprocates the row bar 10 in a direction intersecting with the primary oscillating direction. With the combined oscillating, a moving locus of the row bar 10 in one period draws substantially a letter of 8 as illustrated in FIGS. 10A to 10H.

Phases of a primary oscillating shaft illustrated in FIGS. 10A to 10H can be detected by an origin sensor (not shown) provided on a rotation shaft of a pulley 67. In each phase, a primary oscillating direction and a secondary oscillating direction of the row bar 10 and a rotation direction of the lapping plate 25 are shown with arrows.

As illustrated in FIG. 3, the combined oscillating mechanism 60 comprises a primary oscillating mechanism 61 which primary oscillates the row bar 10 and a secondary oscillating mechanism 62 which secondary oscillates the row bar 10. The primary oscillating mechanism 61 comprises an arm 64 which is turnably supported by a shaft 63 on the elevating sub-base 43, a motor 65 provided on the elevating sub-base 43, a pulley 67 which is rotatably provided on the elevating sub-base 43 and is rotated via a timing belt 66 by a pulley 65*a* of the motor 65, and an eccentric cam 68 which is integrally rotated with the pulley 67 and is provided in a long hole 64*a* of the arm 64. Thus, if the motor 65 is driven, the pulley 67, a later-described pulley 72 and the eccentric cam 68 are rotated, and the arm 64 is primary oscillated by the cam function.

As illustrated in FIG. 3, the secondary oscillating mechanism 62 comprises an arc guide rail 70 provided on the arm 64, a slide structure 71 which is slidably supported on the guide rail 70, a pulley 72 which is rotatably supported by the elevating sub-base 43 and around which the timing belt 66 is wound, a rotation arm 73 which is coaxially provided on the pulley 72, an electromagnetic clutch 74 having a rotation arm 73 connected such that the rotation arm 73 moves in association with rotation of the pulley 72 in its ON state, and a link 75 which connects the rotation arm 73 and the slide structure 71 to each other.

As illustrated in FIG. 5, the rotation arm 73 is provided with a detection piece 73*a* which detects an origin position (reference position) of the rotation arm 73 by an origin sensor 76. Similarly, an origin position (reference position) of the arm 64 is detected by an origin sensor (not shown) provided on a rotation shaft of the pulley 67. These origin sensors can also detect a oscillating phase.

According to the combined oscillating mechanism 60 having the above-described configuration, when the electromagnetic clutch 74 is in its ON state, since the pulley 72 and the rotation arm 73 are connected to each other, the rotation arm 73 is rotated by rotation of the pulley 72, the slide structure 71 is secondary oscillated through the link 75 and with this, the row bar 10 is oscillated in the combined manner.

When the electromagnetic clutch 74 is in its OFF state, since the pulley 72 and the rotation arm 73 are not connected to each other, the rotation arm 73 does not rotate even if the pulley 72 rotates, and since the slide structure 71 does not turn and oscillate, the arm 64 is primary oscillated only.

As illustrated in FIGS. 4, 8 and 9, the slide structure 71 comprises a slide body 77 and a connecting member 78 which is fitted to the slide body 77. As will be explained later, a support frame 79 which turnably supports the bend unit 35 is connected to the connecting member 78 by a pin 79*a*.

A rear end of the bend unit 35 is turnably supported by a bearing section 82, and the bend unit 35 is vertically turned by a pressurizing cylinder 80. With this configuration, the bend unit 35 is pushed or lifted with respect to a direction of the lapping plate 25.

Figure 11:
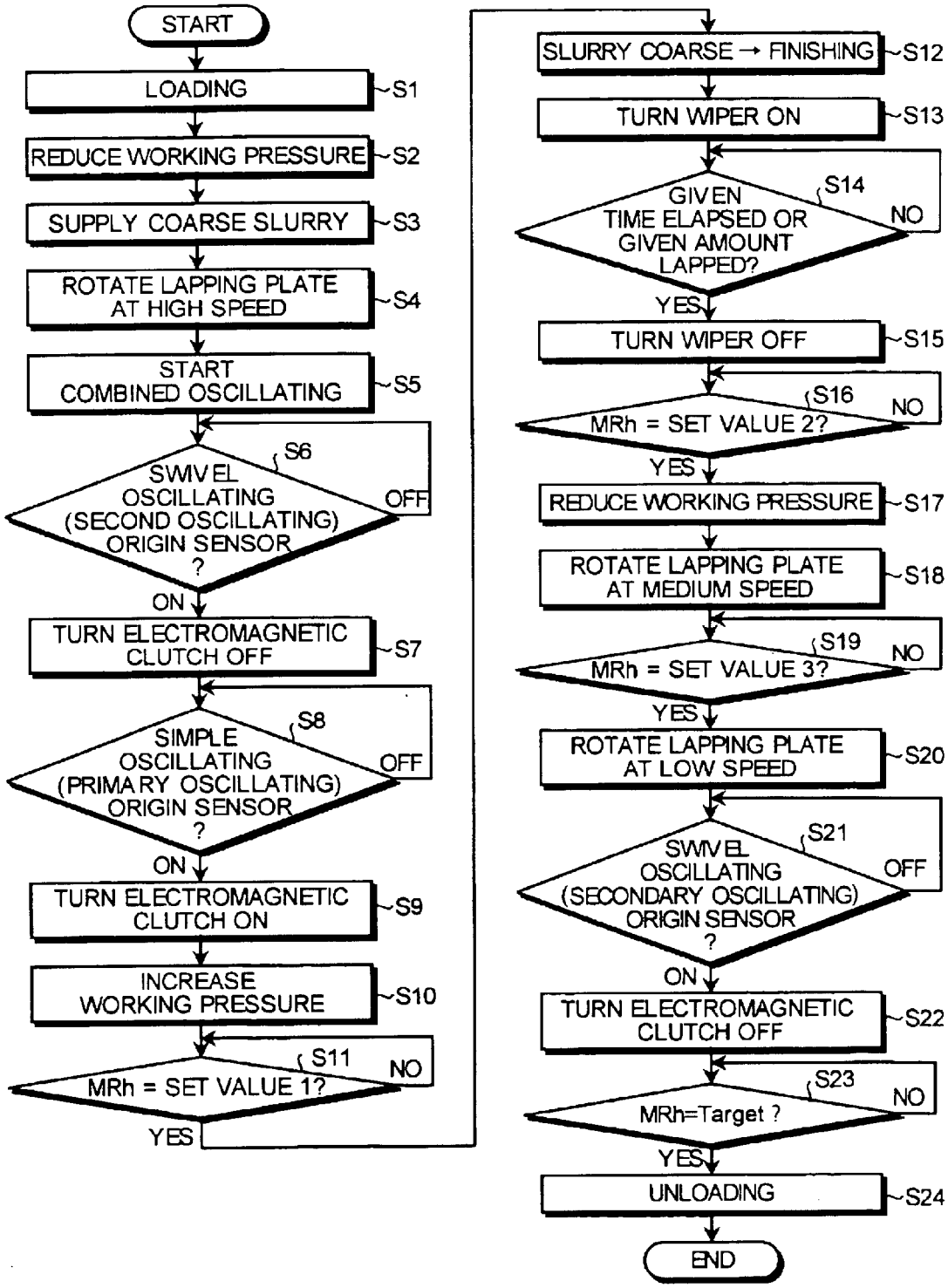
FIG. 11 is a flowchart of a lapping process.
Figure 12:
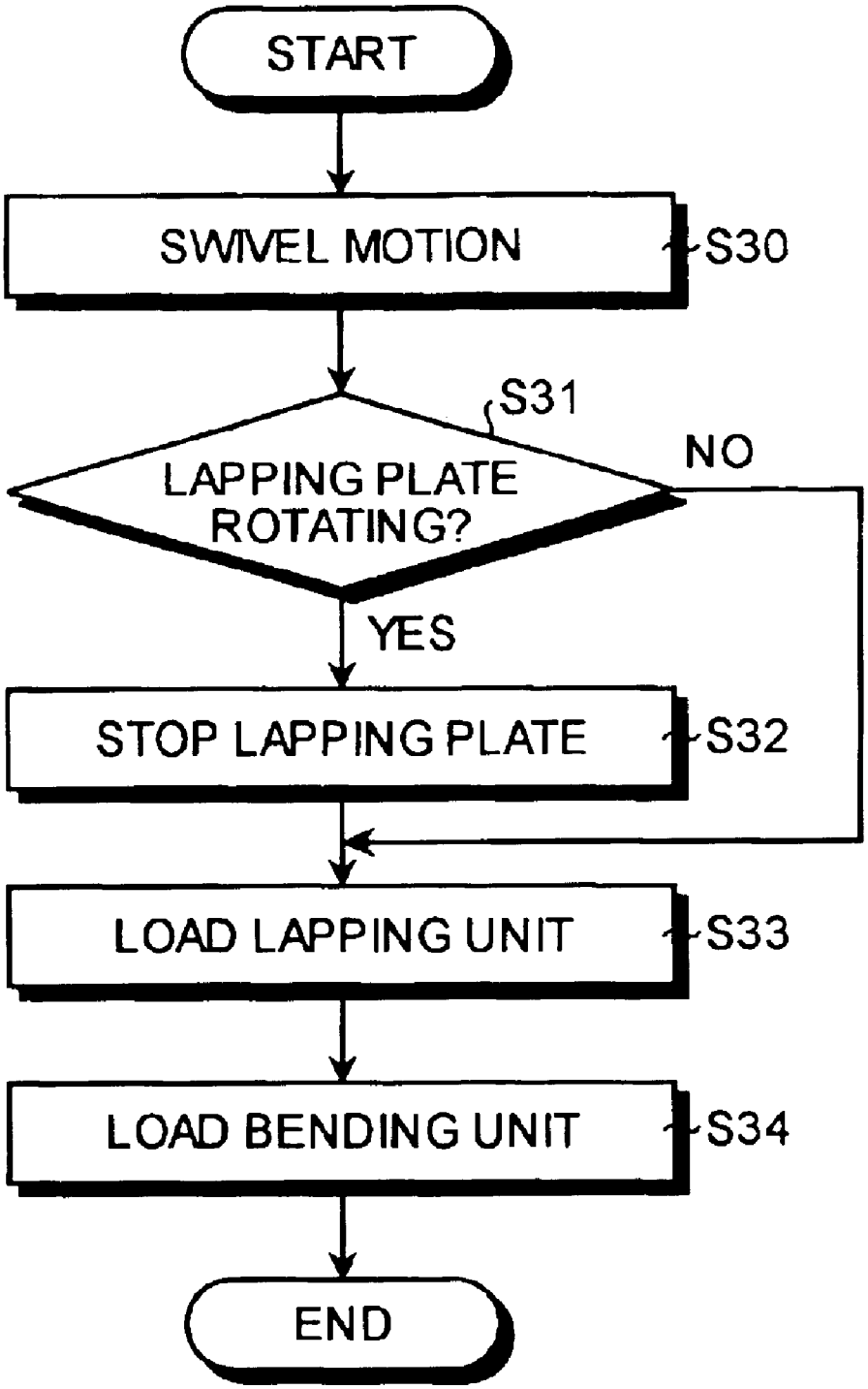
FIG. 12 is a flowchart of a loading process.
Figure 13:
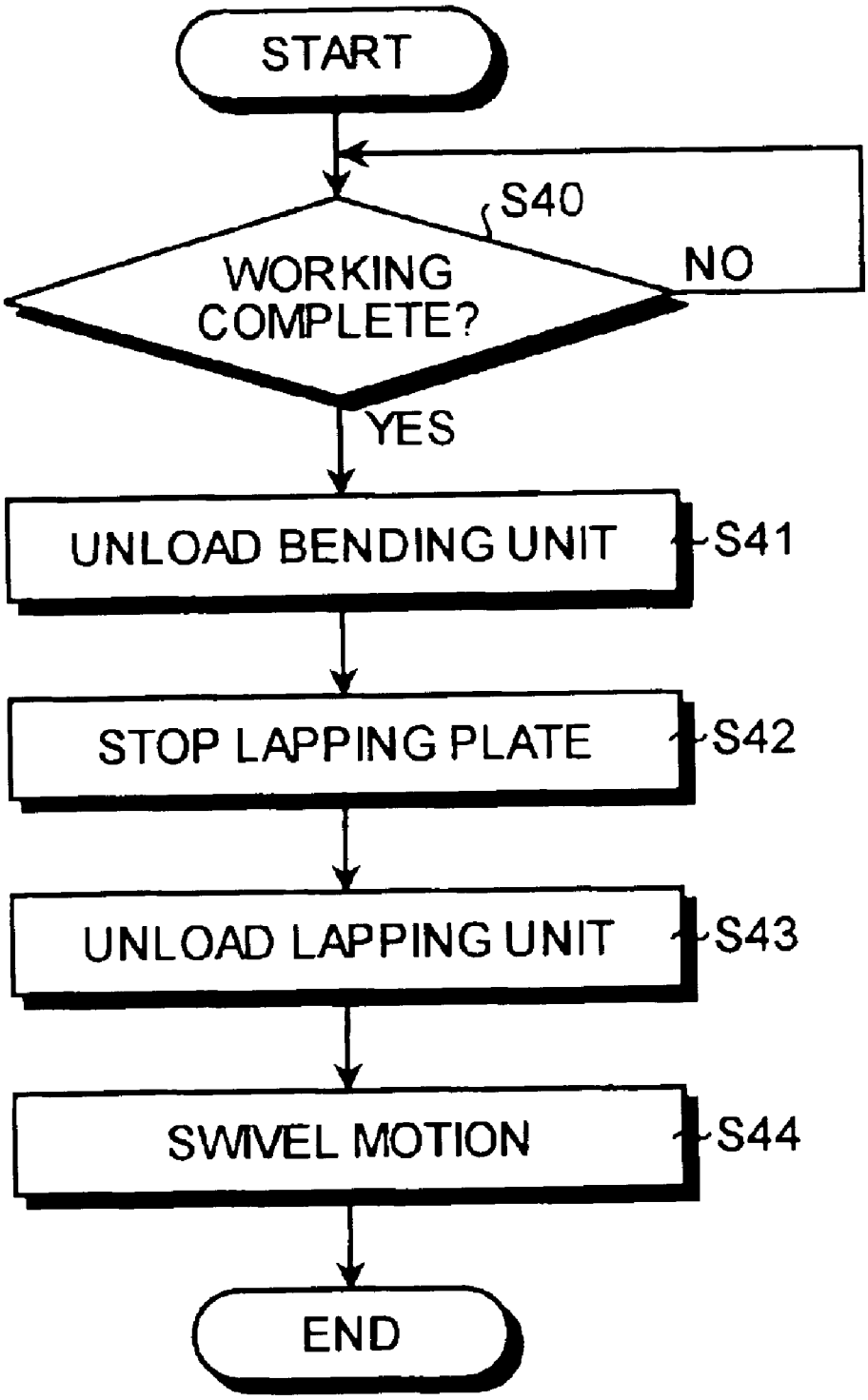
FIG. 13 is a flowchart of an unloading process.

The lapping method will be explained next mainly based on FIGS. 11 to 13. FIG. 11 is a flowchart of a lapping process. FIG. 12 is a flowchart of a loading process. FIG. 13 is a flowchart of an unloading process.

As illustrated in FIG. 11 the loading motion is carried out (step S1). FIG. 12 illustrates details of the loading motion. First, the combined oscillating mechanism 60 is allowed to turn (step S30). As illustrated in FIGS. 6 and 7, in this turning motion, the turning mechanism 46 is driven, the turning support plate 42 and the elevating sub-base 43 are turned through 90°, and the bend unit 35 is disposed above the lapping plate 25 (see FIG. 8).

It is then checked whether the lapping plate 25 is rotating. If the lapping plate 25 is rotating, the lapping plate 25 is stopped (steps S31, S32). Then, the arm 64 of the lap unit 26 is loaded (step S33). That is, as illustrated in FIGS. 8 and 9, the pressurizing cylinder 50 is driven, the elevating sub-base 43 is lowered while being guided by the four guides 49 and the arm 64 is lowered.

The bend unit 35 is then loaded (step S34). The pressurizing cylinder 80 is driven, the bend unit 35 is downwardly turned around the bearing section 82 and is lowered, and the row bar 10 comes into contact with the upper surface of the lapping plate 25. As illustrated in FIG. 7, the row bar 10 is disposed in such a direction that a longitudinal direction of the row bar 10 coincides with a radial direction of the lapping plate 25, and this position is defined as an origin (reference) position.

As illustrated in FIG. 11, a working pressure by the pressurizing cylinder 80 is reduced (step S2) and then, rough slurry including diamond powder is supplied (step S3), and the lapping plate 25 is allowed to rotate at high speed (e.g., 50 revolutions per minute) (step S4).

The combined oscillating is then started (step S5). At that time, the oscillating periods of the secondary oscillating and the primary oscillating are brought into synchronization with each other (steps S6 to S9). That is, if the origin sensor 76 of the secondary oscillating checks the origin position, the electromagnetic clutch 74 is turned OFF (steps S6 and S7). If the origin sensor (not shown) of the primary oscillating provided on the rotation shaft of the pulley 67 checks the origin position, the electromagnetic clutch 74 is turned ON to carry out the combined oscillating (steps S8 and S9). With this, it is possible to continuously and precisely manage the timing of the lapping, and to enhance the profile regularity.

In order to carry out the rough lapping by the combined oscillating, the working pressure by the pressurizing cylinder 80 is set greater (step S10). If the converted value MRh becomes equal to a first set value, the lapping operation proceeds to the finishing lapping (steps S11 and S12).

That is, finishing slurry without diamond powder is supplied (step S12), and the wiper unit 28 is turned ON to start scraping off the rough slurry from the lapping plate 25 (step S13). If a given time is elapsed or a predetermined lapping operation is completed, the wiper unit 28 is turned OFF (steps S14 and S15). With these steps, the finishing slurry spreads on the lapping plate 25, and the lapping plate 25 is suitable for the finishing lapping.

If the converted value MRh becomes equal to a second set value (step S16), the working pressure is reduced (step S17), and the rotation speed of the lapping plate 25 is changed to a medium speed (e.g., about 25 revolutions per minute) (step S18). Next, if the converted value MRh becomes equal to a third set value (step S19), the rotation speed of the lapping plate 25 is set to a low speed (step S20). This rotation speed is 5 revolutions per minute or lower and, more preferably, 1 revolution per minute or lower.

Next, if the origin sensor 76 of the secondary oscillating checks the origin position (step S21), the electromagnetic clutch 74 is turned OFF (step S22), the oscillating manner is switched to the primary oscillating manner and the finishing lapping is carried out. If the converted value MRh becomes equal to the target value (Target) (step S23), the unloading motion is carried out (step S24).

FIG. 13 depicts the details of the unloading motion. It is checked that the working is completed, and the unloading motion of the bend unit 35 is carried out (steps S40 and S41). That is, the pressurizing cylinder 80 is driven, the bend unit 35 is upwardly turned around the bearing section 82 and lifted up, and the row bar 10 is separated from the upper surface of the lapping plate 25.

The rotation of the lapping plate 25 is stopped (step S42), and the lap unit 26 is unloaded in a manner which is the reverse of the loading motion. The lap unit 26 is turned and returned to its initial position (steps S43 and S44). With the above operation, the lapping operation is completed.

As described above, according to the lapping apparatus 20 and the lapping method of the first embodiment, after the rough lapping by means of the combined oscillating is carried out, the oscillating manner is switched to the primary oscillating manner in the finishing state which is close to the target value, and the finishing lapping is carried out at low speed under the small working pressure. Therefore, the lapping precision can further be enhanced, and scratch or smear can be prevented from being generated between the gaps of the MR elements or ELG elements.

The lapping apparatus 20 is not limited to the lapping operation of the row bar 10 to obtain the combined type magnetic head having a slider as a final product, and the lapping apparatus 20 can also be applied to a lapping operation of other members.

Figure 14:
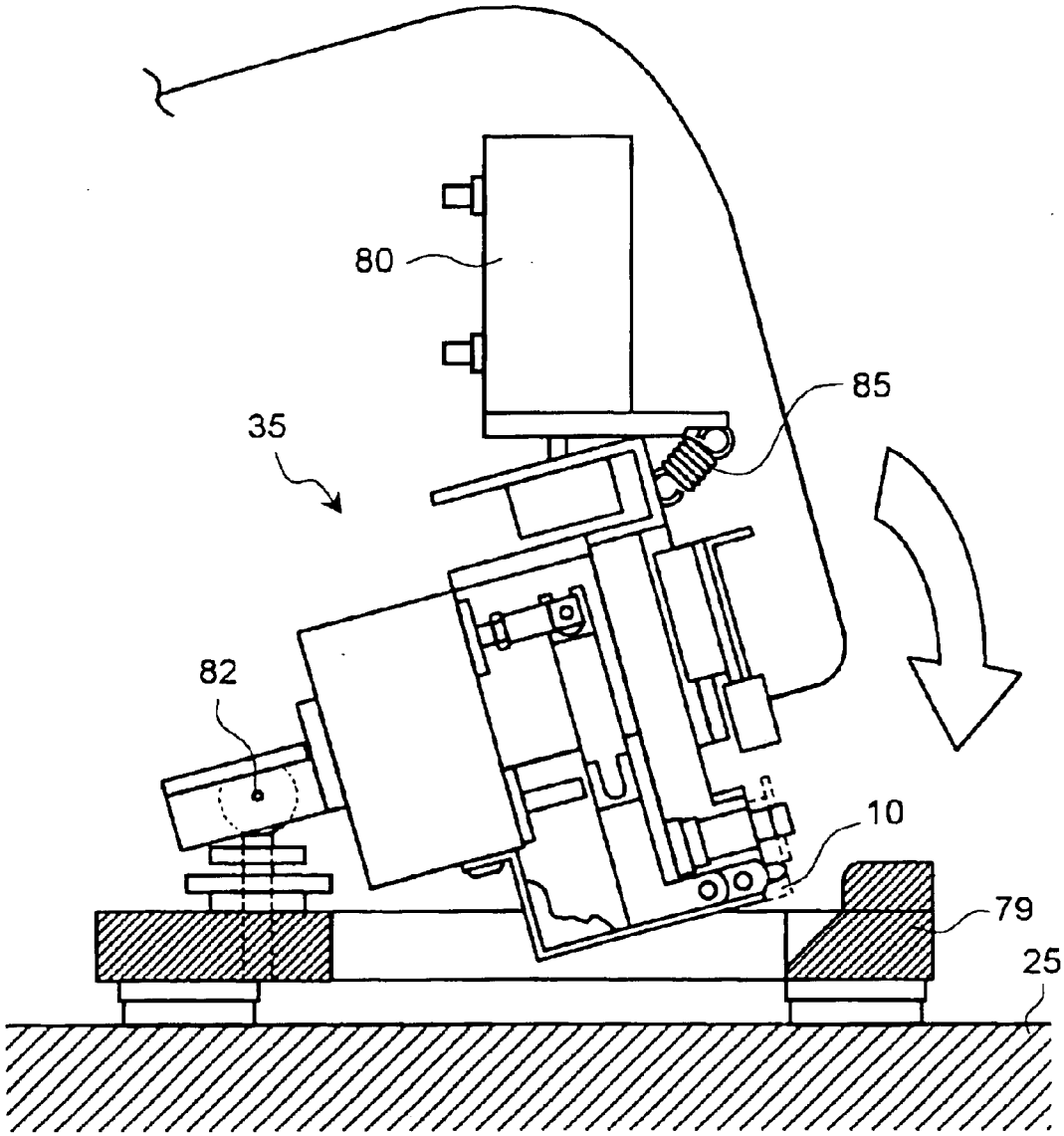
FIG. 14 is a front view for illustrating a loading motion of a bend unit according to a second embodiment of the present invention.
Figure 15:
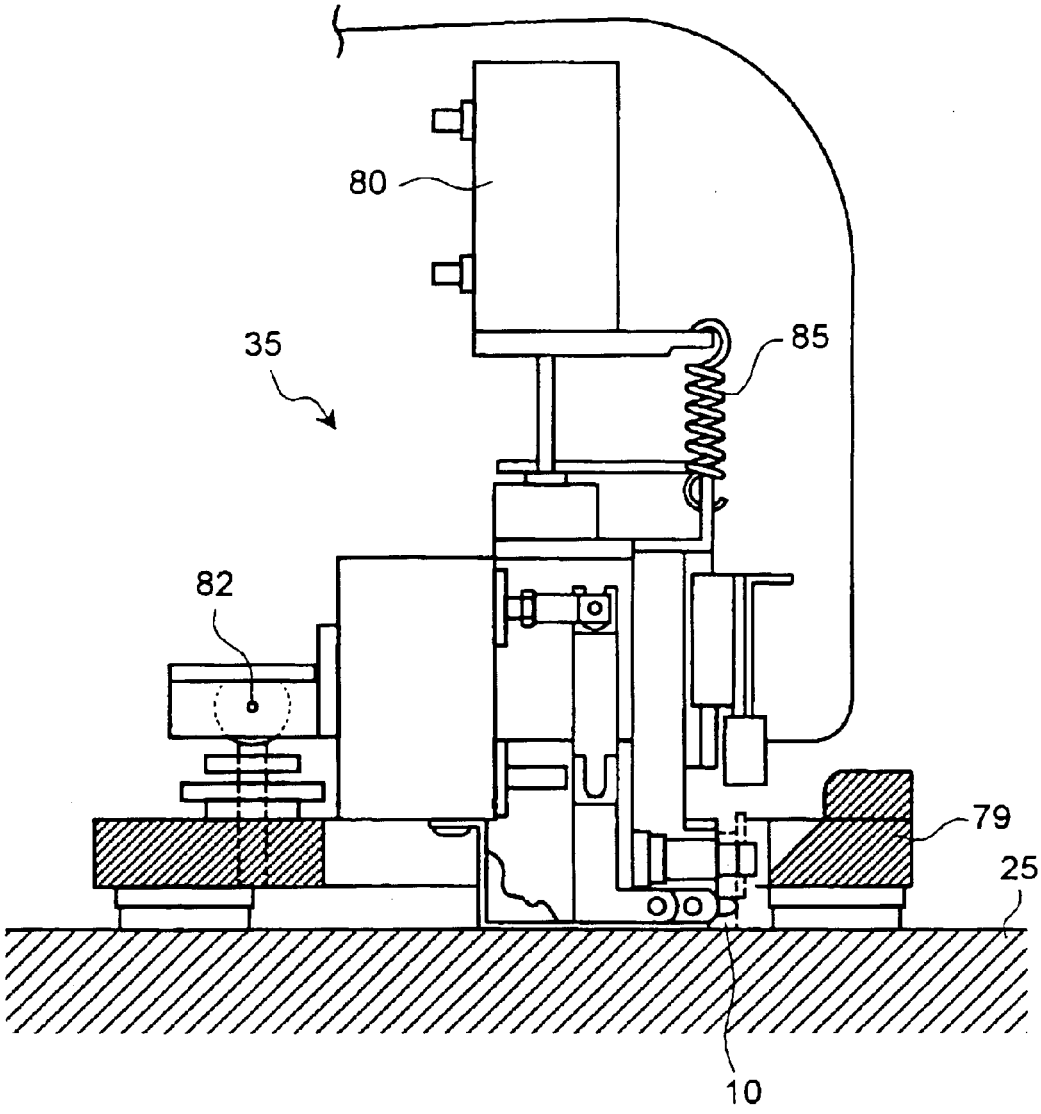
FIG. 15 is a front view for illustrating the loading motion using an extension coil spring.
Figure 16:
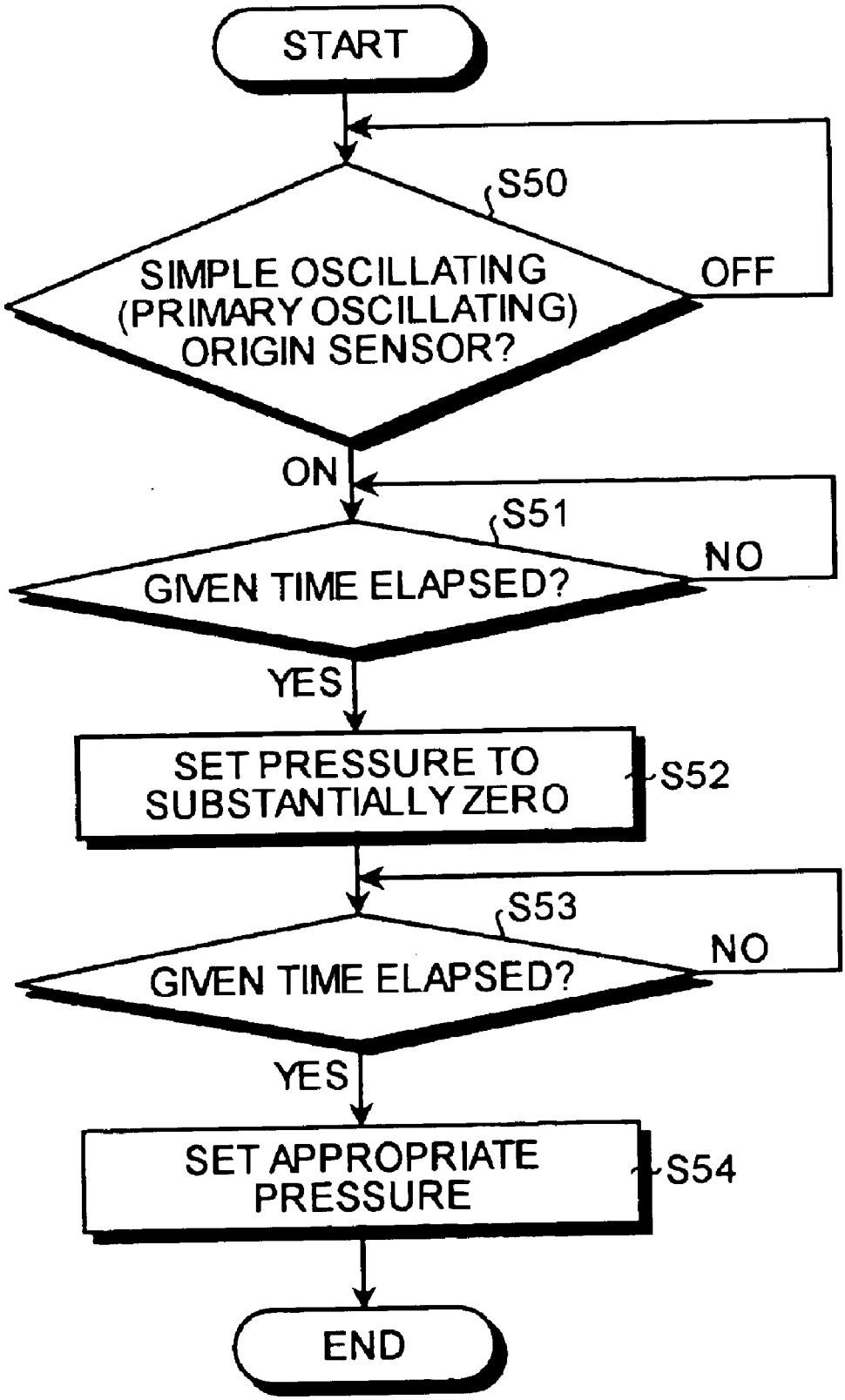
FIG. 16 is a flowchart of a control for reducing a working pressure at both an initial and final positions of the primary oscillating motion.
Figure 17:
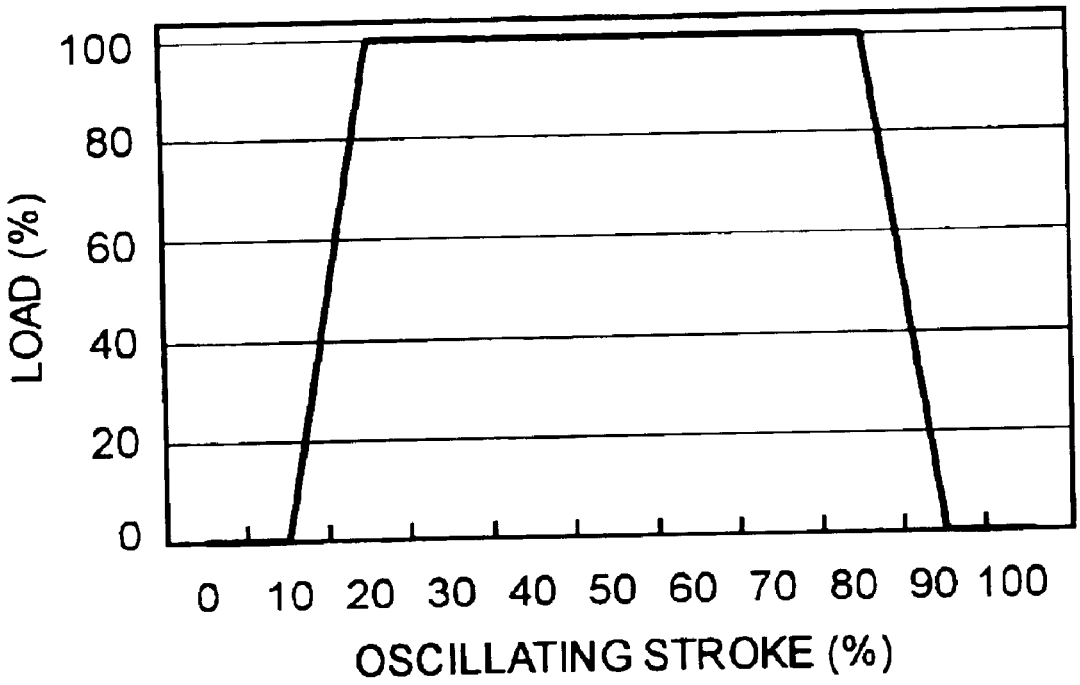
FIG. 17 is a graph of a relation between a oscillating stroke and a load.

FIG. 14 is a front view for illustrating a loading motion of a bend unit according to a second embodiment of the present invention. FIG. 15 is a front view for illustrating the loading motion using an extension coil spring. FIG. 16 is a flowchart of a control for reducing a working pressure at both an initial and final positions of the primary oscillating motion. FIG. 17 is a graph of a relation between a oscillating stroke and a load.

In the second embodiment, the lapping pressure at a dead center of the primary oscillating speed is set to zero or about zero at the time of the finishing lapping by means of the primary oscillating explained in the first embodiment. That is, as illustrated in FIGS. 14 and 15, the bend unit 35 is hoisted and the working pressure by the weight of the bend unit 35 itself is set to zero or about zero by disposing an extension coil spring 85 having a predetermined strength, the working pressure of the pressurizing cylinder 80 is controlled at the dead center of the primary oscillating speed and the working pressure is set to zero or about zero.

An upper end of the extension coil spring 85 is connected to a base or the like of the pressurizing cylinder 80, and a lower end of the extension coil spring 85 is connected to an upper portion of the bend unit 35. If the same pressure reducing effect as that of the extension coil spring 85 can be exhibited, the means is not limited to the extension coil spring, and other means such as an oil damper may be used.

The control operation of the working pressure of the pressurizing cylinder 80 will be explained based on FIGS. 16 and 17. First, the origin position is checked by the primary oscillating origin sensor (not shown) provided on the rotation shaft of the pulley 67, and if a given time is elapsed (steps S50 and S51), the dead center of the primary oscillating speed (position where the oscillating stroke in FIG. 17 is 0 to 10% and 90 to 100%) can be detected. Therefore, the pressurizing pressure by the pressurizing cylinder 80 is set to zero or about zero (step S52). If another given time is elapsed, i.e., at speed other than the dead center of the primary oscillating speed, an appropriate pressurizing pressure is set by the pressurizing cylinder 80 (steps 53 and S54).

According to the lapping apparatus 20 and the lapping method of the second embodiment, as described above, since the lapping pressure is set to zero or about zero at the dead center of the primary oscillating speed at the time of the finishing lapping by the primary oscillating, the lapping is barely carried out at the dead center, and the scratch or smear can be prevented from being generated between the gaps of the MR elements or ELG elements.

Figure 18:
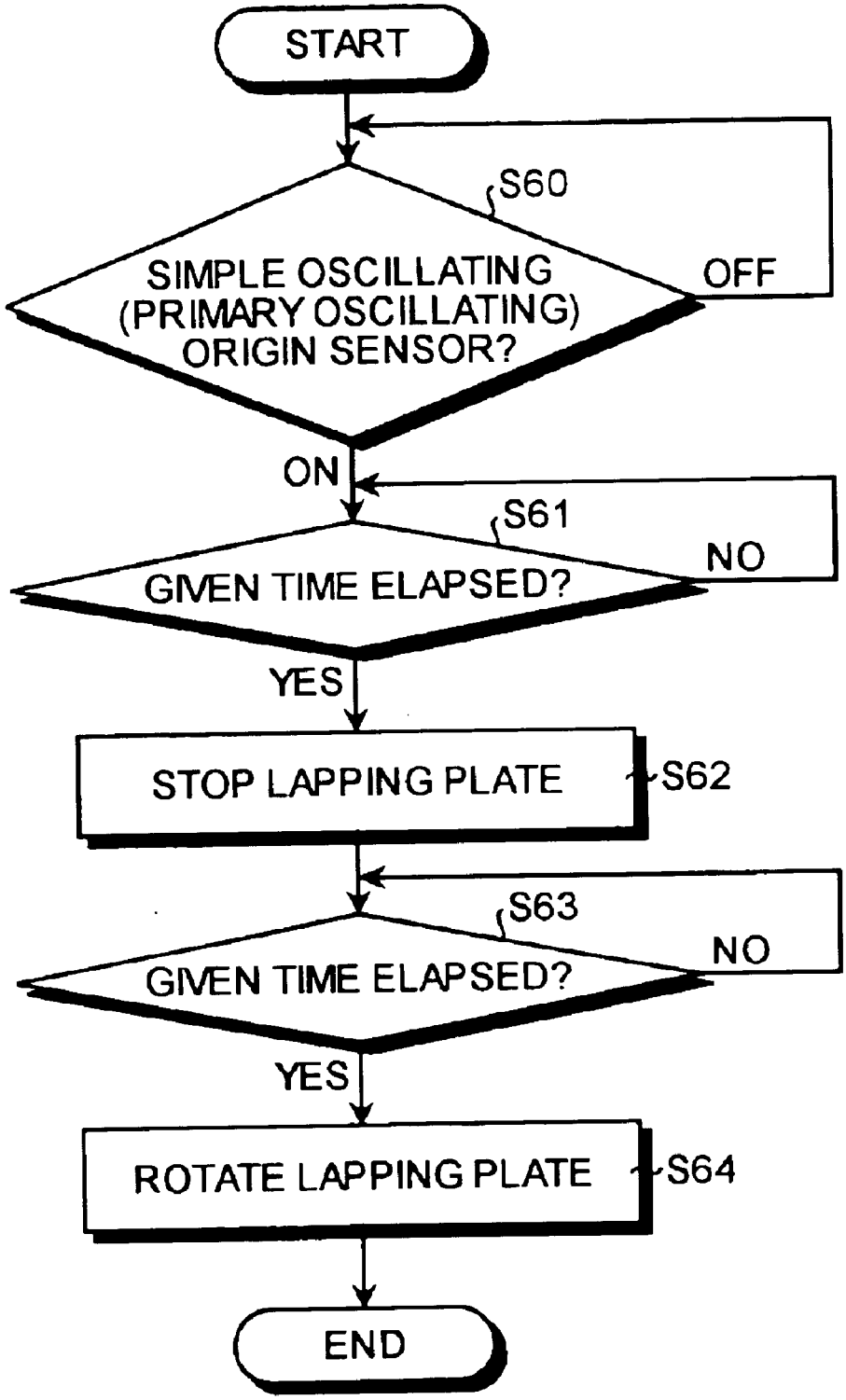
FIG. 18 is a flowchart of a control to stop a lapping plate at both an initial and a final position of the primary oscillating motion according to a third embodiment of the present invention.
Figure 19:
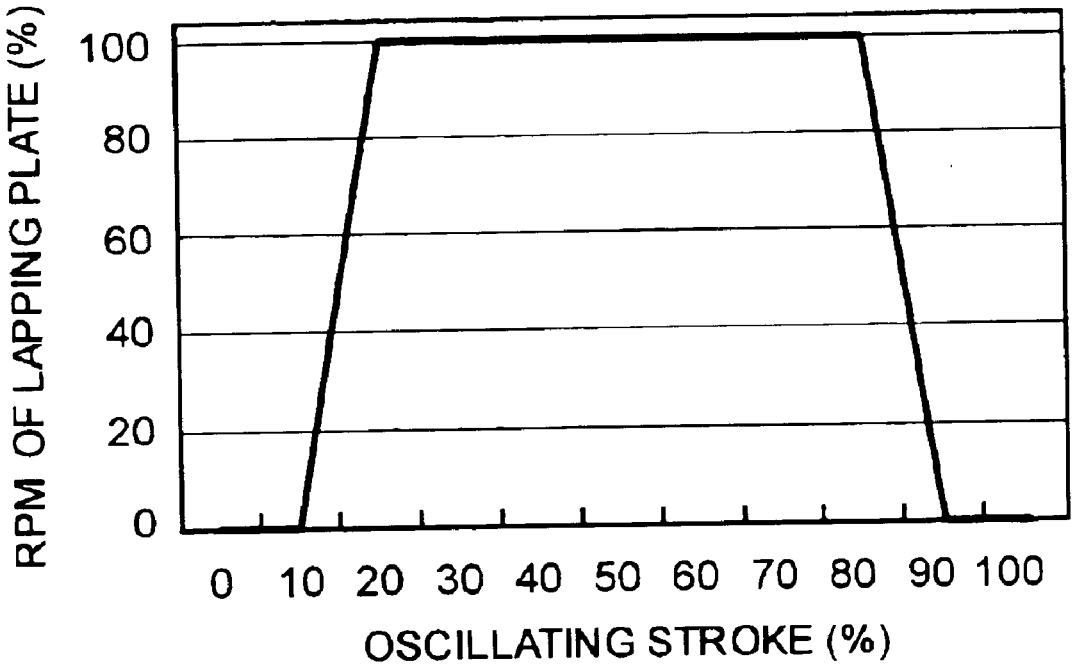
FIG. 19 is a graph of a relation between a oscillating stroke and percentage revolutions per minute (rpm) of the lapping plate.
Figure 20:
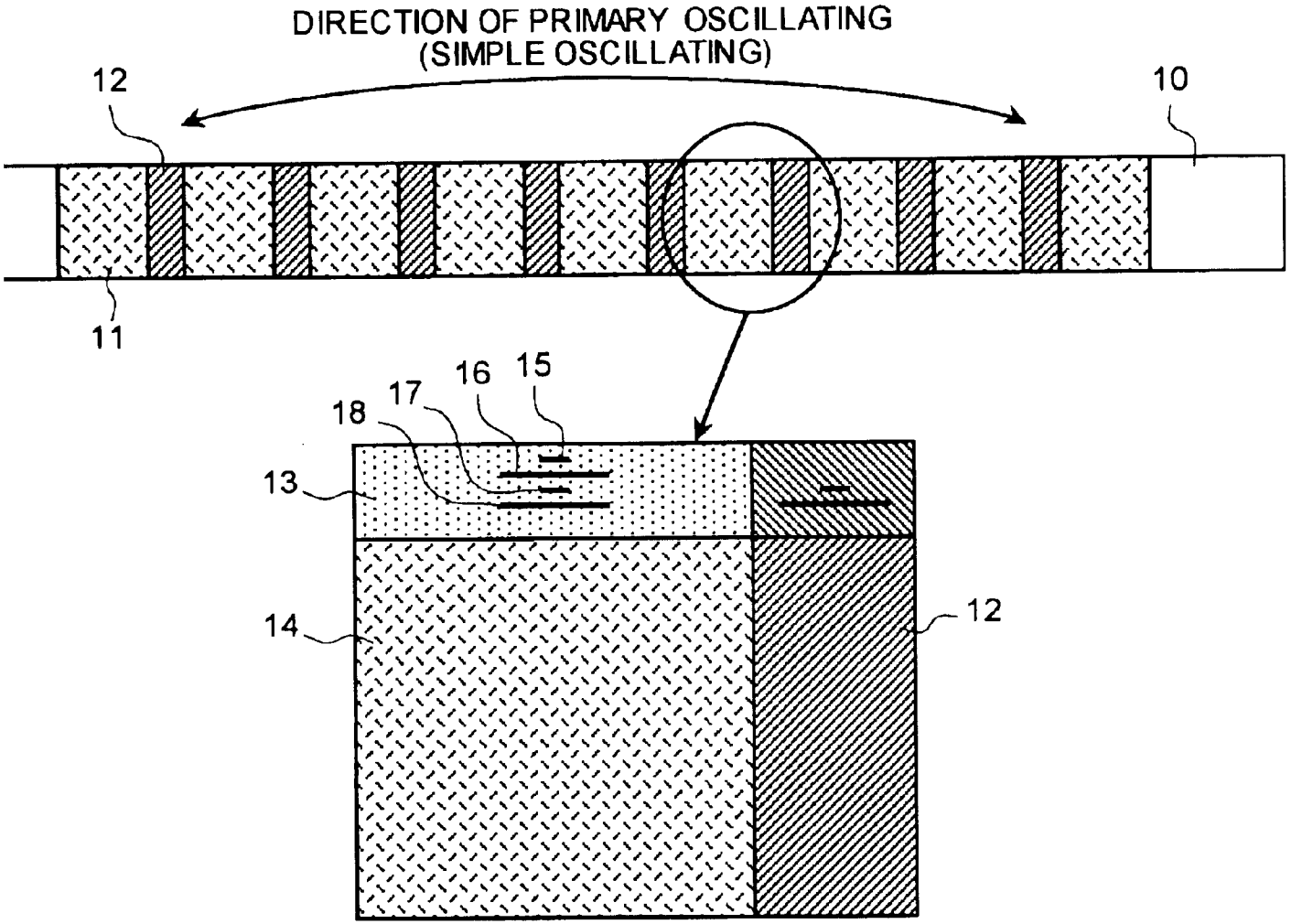
FIG. 20 is a schematic diagram of a row bar as viewed from a surface the row bar to be lapped.
Figure 21:
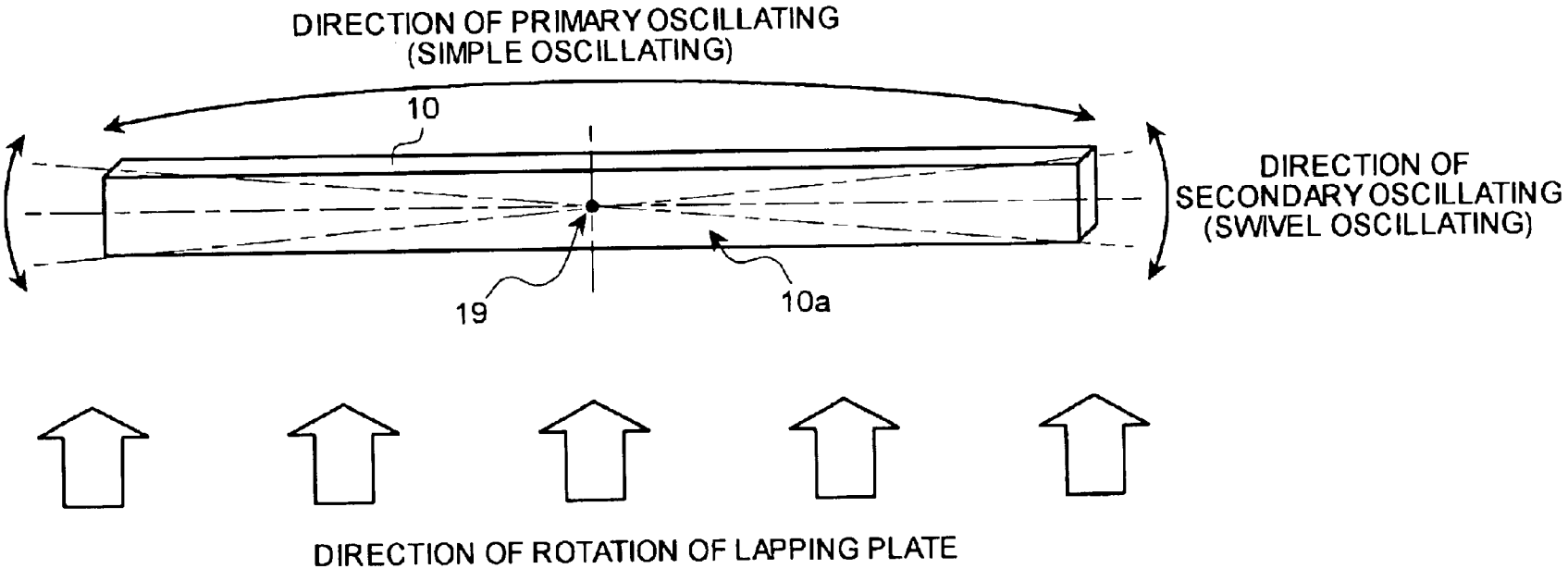
FIG. 21 is a schematic diagram of the lapping direction component as viewed from the surface of the row bar to be lapped.

FIG. 18 is a flowchart of a control to stop a lapping plate at both an initial and a final position of the primary oscillating motion according to a third embodiment of the present invention. FIG. 19 is a graph of a relation between a oscillating stroke and percentage revolutions per minute (rpm) of the lapping plate.

According to the third embodiment, in the finishing lapping by the primary oscillating explained in the first embodiment, the lapping apparatus 20 is controlled such that the number of rotation of the lapping plate 25 is set to zero at the dead center of the primary oscillating speed.

Next, the control of the rotation number of the lapping plate 25 will be explained based on FIGS. 18 and 19. First, the origin position is checked by the primary oscillating origin sensor (not shown) provided on the rotation shaft of the pulley 67, and if a given time is elapsed (steps S60 and S61), the dead center of the primary oscillating speed (position where the oscillating stroke in FIG. 19 is 0 to 10% and 90 to 100%) can be detected. Therefore, the rotation of the lapping plate 25 is stopped, and a relative speed between the surface to be polished and the lapping plate 25 is set to zero (step S62). If another given time is elapsed, i.e., at speed other than the dead center of the primary oscillating speed, the lapping plate 25 is allowed to rotate again, and the lapping is carried out (steps S63 and S64).

According to the lapping apparatus 20 and the lapping method of the third embodiment, as described above, since the lapping plate 25 is controlled such that its rotation number is set to zero at the dead center of the primary oscillating speed at the time of the finishing lapping by the primary oscillating, the lapping operation by the rotation component of the lapping plate 25 is not carried out at the dead center, and the scratch or smear can be prevented from being generated between the gaps of the MR elements or ELG elements.

Although the rotation of the lapping plate 25 is stopped in the third embodiment, the present invention is not limited to this only, and the lapping plate 25 may be controlled such that the rotation number is close to zero (e.g., 0.5 revolution per minute).

As explained above, according to the present invention, the lapping precision can further be enhanced, and the scratch or smear can be prevented from being generated between the gaps of the MR elements or ELG elements.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of lapping a magnetic head slider, comprising:

contacting a lapping plate to a bar of the magnetic head slider by a predetermined lapping pressure;

performing a coarse lapping of the bar by a combined oscillating of a primary oscillating and a secondary oscillating, wherein the primary oscillating of the bar is in a radial direction of the lapping plate, and the secondary oscillating of the bar is in a direction perpendicular to a direction of the primary oscillating; and upon completion of the coarse lapping, switching to only the primary oscillating to finish lapping of the bar.

2. The method according to claim 1, further comprising:

setting at a time of the primary oscillating, the lapping pressure to substantially zero at dead center of speed of the primary oscillating.

3. The method according to claim 1, further comprising rotating the lapping plate by a mechanism, wherein the mechanism substantially stops rotation of the lapping plate at dead center of speed of the primary oscillating.

4. The method according to claim 1, wherein oscillating cycles of the primary oscillating and the secondary oscillating are synchronized with each other at a time of the combined oscillating when a new bar is loaded.

5. The method according to claim 1, wherein at a time of the finishing lapping by the primary oscillating, the direction of the primary oscillating makes an angle to a rotational direction of the lapping plate.

6. A method of lapping a magnetic head slider, comprising:

performing a coarse lapping of a bar of the magnetic head slider by performing a combined oscillating of the bar; and finishing lapping of the bar by discontinuing the combined oscillating and performing only a primary oscillating, wherein the combined oscillating of the bar of the magnetic head slider is performed while the bar is making a contact with a lapping plate by a predetermined lapping pressure, the combined oscillating including:

primary oscillating the bar in a radial direction of the lapping plate; and secondary oscillating the bar in a direction perpendicular to a direction of the primary oscillating.

7. The method according to claim 6, further comprising:

setting, at a time of the primary oscillating, a lapping pressure to substantially zero at dead center of speed of the primary oscillating.

8. The method according to claim 6, further comprising:

setting a speed of rotation of the lapping plate to substantially zero at dead center of speed of the primary oscillating.

9. The method according to claim 6, wherein oscillating cycles of the primary oscillating and the secondary oscillating are synchronized with each other at a time of the combined oscillating after a new bar is loaded.

10. The method according to claim 6, wherein at a time of the finishing lapping by the primary oscillating, the direction of the primary oscillating makes an angle to a rotational direction of the lapping plate.

* * * * *